United States Patent [19]

Yanagisawa

[11] Patent Number: 4,928,566

[45] Date of Patent: May 29, 1990

[54] DEVICE FOR APPLYING TENSION TO A PAIR OF DRUM HEADS

[75] Inventor: Mitsuo Yanagisawa, Yachiyo, Japan

[73] Assignee: Pearl Musical Instrument Co., Tokyo, Japan

[21] Appl. No.: 352,103

[22] Filed: May 15, 1989

[30] Foreign Application Priority Data

Oct. 20, 1988 [JP] Japan ..... 63-136139[U]

[51] Int. Cl.[5] ..... G10D 13/02

[52] U.S. Cl. ..... 84/413

[58] Field of Search ..... 84/411 R, 413, 415

[56] References Cited

U.S. PATENT DOCUMENTS

| | | | |
|---|---|---|---|
| 2,092,980 | 9/1937 | Ludwig | 84/411 R |
| 3,911,779 | 10/1975 | Della-Porta | 84/411 R |
| 4,448,105 | 5/1984 | Cordes | 84/413 |
| 4,660,455 | 4/1987 | Jones et al. | 84/413 |
| 4,714,002 | 12/1987 | Cleland | 84/413 |

*Primary Examiner*—Lawrence R. Franklin

*Attorney, Agent, or Firm*—Frishauf, Holtz, Goodman & Woodward

[57] ABSTRACT

A pair of tension bolts for applying tension to a pair of drum heads are screwed individually into nuts. These nuts are held individually by means of a pair of lug bodies which are fixed to a drum shell. The lug bodies, which are formed by die casting, are connected to each other by means of a connecting member. The connecting member, which has a uniform cross-sectional shape throughout its length, is formed by pressing a metal plate with a predetermined length, or by cutting a metal pipe into a predetermined length. Two opposite end portions of the connecting member are fitted individually in openings at the respective end portions of the lug bodies. A hole is formed in each end portion of the connecting member. The lug bodies and the connecting member are connected so that projections on the lug bodies are fitted individually in the holes of the connecting member.

6 Claims, 5 Drawing Sheets

DEVICE FOR APPLYING TENSION TO A PAIR OF DRUM HEADS

BACKGROUND OF THE INVENTION

1. Field of the Invention

The present invention relates to a drum as a percussion instrument, and more particularly, to an improved tightening device for applying tension to a pair of drum heads.

2. Description of the Related Art

Drums for percussion, such as bass drums, snare drums, floor tom-toms, aerial tom-toms, etc., comprise a cylindrical drum shell open at both ends, a pair of drum heads individually covering two opposite end openings of the drum shell, and means for applying tension to the drum heads. The tensioning means includes hoops arranged along the respective edges of the drum heads, tension bolts inserted individually in holes in the hoops, and metal lugs having nuts into which the tension bolts are screwed. The lugs are fixed to the drum shell by means of screws.

Conventional metal lugs can be classified into two types; one-way type and two-way type. In the one-way lugs, the nut mating with the tension bolt is provided only on one side of a lug body. Accordingly, the one-way lugs can apply tension to only one of the drum heads. The lugs of this type can be made relatively compact. In these lugs, however, the lug body is pulled strongly from only one side by the tensile force of the drum head, so that lug mounting portions of the drum shell and the tension bolts are subjected to a great bending stress. Thus, if the drum head is subjected to excessive tension, the lug mounting portions or the tension bolts may possibly be deformed or bent.

On the other hand, the conventional two-way lugs are provided with an elongated lug body extending in the axial direction of the drum shell. The whole lug body is integrally formed by casting. The nut mating with the tension bolt is provided at each end of the lug body. In a drum using the two-way lugs constructed in this manner, the respective edges of the drum heads are simultaneously pulled toward each other by means of the paired tension bolts. In other words, the lug body is subjected to two opposite tensions in the axial direction of the drum shell. Since these reciprocal forces on the lug body are balanced with each other, the lug body can withstand great deal of tension. Thus, the metal lugs of this type are called high-tension lugs.

The body of the high-tension lugs must have a length agreeable to the axial dimension of the drum shell. If the lug body is too short, the distance between itself and each hoop is so long that the lug body and the hoops cannot be connected by means of regular tension bolts. If the lug body is too long, on the other hand, its ends may engage the hoops, so that the drum heads cannot be subjected to tension. Therefore, the lug body must have the length best suited for the axial length of the drum shell. Since the lug bodies are formed by casting, however, production of lug bodies of different lengths requires use of dies of as many types as the lug body types. In consequence, increased types of lug bodies require an increased number of dies, thus entailing an increase in the manufacturing costs of the lug bodies.

SUMMARY OF THE INVENTION

Accordingly, the object of the present invention is to provide a high-tension tightening device in which lug bodies of one type can be used with drum shells of various types, so that the components are versatile, and manufacturing costs are reduced.

According to a tightening device of the present invention, a pair of lug bodies can be connected by means of a connecting member, which is cut into a suitable length depending on the axial dimension of a drum shell. Thus, lug bodies of one type can be used with drum shells of various types.

The tightening device of the present invention is a device for applying tension to a pair of drum heads individually covering two opposite end openings of a drum shell open at both ends in the axial direction and having first holes, comprising: a pair of hoops arranged along the respective edges of the drum heads, each of the hoops having second holes arranged circumferentially at regular intervals; tension bolts each including a shank portion having an external thread, the shank portion being passed through each corresponding second hole; nuts, each including a cylinder portion and a flange situated at an end thereof, the cylinder portion having an internal thread mating with the external thread of each corresponding tension bolt; a pair of metallic lug bodies formed by casting, each of the lug bodies being in the form of a box, open on the drum shell side, and having first and second ends situated opposite each other, the first end having a first opening in which the cylinder portion of each corresponding nut is inserted, and the second end having a second opening, the first and second openings extending in the axial direction of the drum shell; first projections each located in the vicinity of the first end of each of the lug bodies and adapted to be inserted into the first hole of the drum shell, each of the first projections having a tapped hole; second projections each located in the vicinity of the second end of each of the lug bodies and projecting toward the drum shell; rotation preventing means inside each of the lug bodies for preventing each of the nuts from rotating; first screws screwed individually in the tapped holes of the first projections of the lug bodies, the lug bodies being adapted to be fixed to the drum shell as the screw are screwed into the tapped holes; and a connecting member for connecting the paired lug bodies, the connecting member having a longitudinal axis extending in the axial direction of the drum shell and two opposite end portions fitted individually in the second openings of the lug bodies, the cross section of the connecting member, with respect to the direction perpendicular to the longitudinal axis, being uniform throughout the axial length, each of the opposite end portions of the connecting member having a third hole in which the second projection of each corresponding lug body is fitted.

DETAILED DESCRIPTION OF THE PREFERRED EMBODIMENTS

Figure 1:
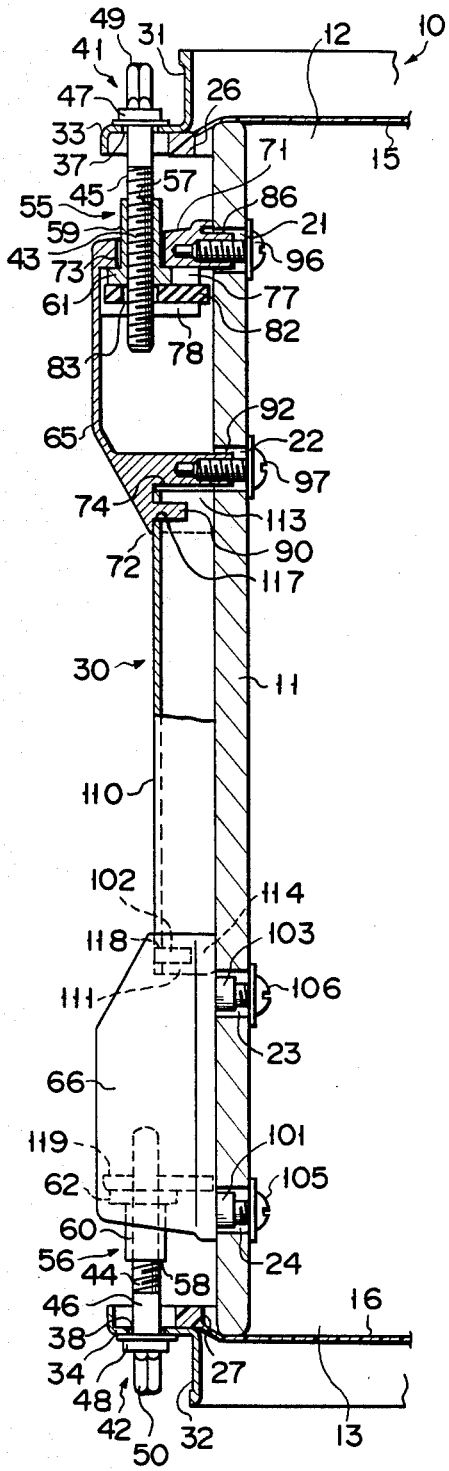
FIG. 1 is a longitudinal sectional view of a tightening device according to a first embodiment of the present invention.
Figure 3:
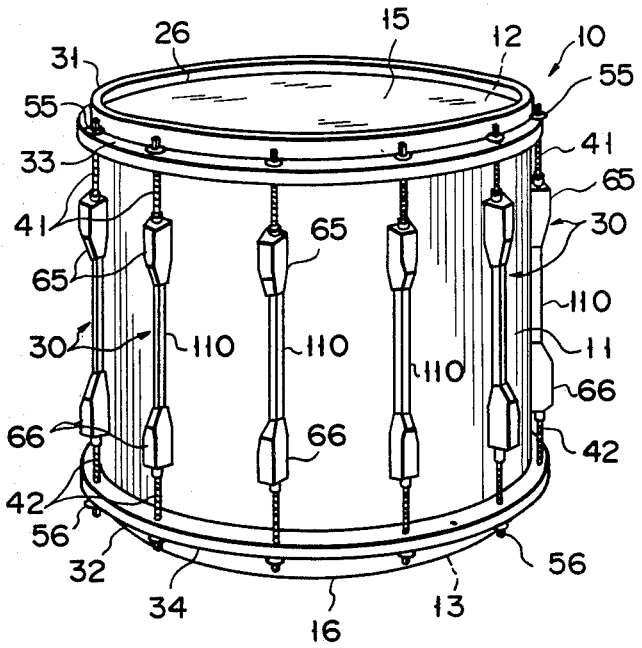
FIG. 3 is a perspective view of a drum provided with the tightening devices of FIG. 1.

As shown in FIG. 3, drum 10 is provided with cylindrical drum shell 11. Both ends of shell 11 open in the axial direction, and openings 12 and 13 are closed by means of drum heads 15 and 16 respectively. Drum shell 11 may be made of any suitable materials, such as fiber-reinforced plastics (FRP), wood, various metals, etc. As shown in FIG. 1, shell 11 has first holes 21, 22, 23 and 24, which are used to fix a pair of lug bodies 65 and 66 (mentioned later) to the shell.

In the present embodiment, drum heads 15 and 16 are formed of synthetic resin. Alternatively, however, they may be made of leather. Edges 26 and 27 of heads 15 and 16 are thicker than the main body portions of the heads. Heads 15 and 16 are subjected to tension by means of tightening devices 30, which will be described below.

A pair of metallic hoops 31 and 32 are provided with ring-shaped seats 33 and 34, respectively, which extend around edges 26 and 27 of drum heads 15 and 16. Seats 33 and 34 have a plurality of second holes 37 and 38 (only some of which are shown), respectively, arranged at regular intervals in the circumferential direction of drum shell 11.

Tension bolts 41 and 42 are passed through second holes 37 and 38, respectively. Bolts 41 and 42 are composed of shank portions 45 and 46 having external threads 43 and 44, flanges 47 and 48, and head portions 49 and 50, respectively. Head portions 49 and 50 have a polygonal cross section such that they can be rotated by means of a tuning key (not shown). Shank portions 45 and 46 are inserted in second holes 37 and 38, respectively.

Nuts 55 and 56, which mate with external threads 43 and 44 of tension bolts 41 and 42, respectively, are composed of cylinder portions 59 and 60, having internal threads 57 and 58, and flanges 61 and 62 located at the ends of portions 59 and 60, respectively. Flanges 61 and 62 are rectangular in shape, as viewed from their end faces.

A pair of lug bodies 65 and 66 are formed by die casting of a zinc-based alloy, and their surfaces are chromium-plated. They may be formed of any metal other than a zinc-based alloy, e.g., an aluminum-based alloy. Since lug bodies 65 and 66 have the same construction, only body 65 will be described in the following.

Lug body 65 is in the form of a box which opens on the side in contact with drum shell 11. It has first end 71 situated on the upper side of FIG. 1 and second end 72 on the opposite side. First end 71 is provided with first opening 73 into which cylinder portion 59 of nut 55 is inserted, while second end 72 is provided with second opening 74. Opening 74 is substantially U-shaped as viewed from the end face of lug body 65. Openings 73 and 74 are arranged in the axial direction of drum shell 11. Since the width of flange 61 of nut 55 is wider than the diameter of first opening 73, nut 55 in opening 73 is prevented from slipping out of lug body 65 by flange 61.

Figure 4:
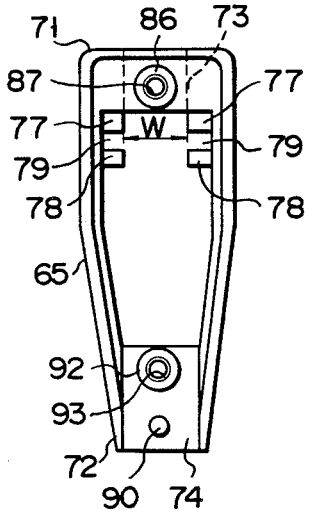
FIG. 4 is a rear view of a lug body of the tightening device shown in FIG. 1.
Figure 5:
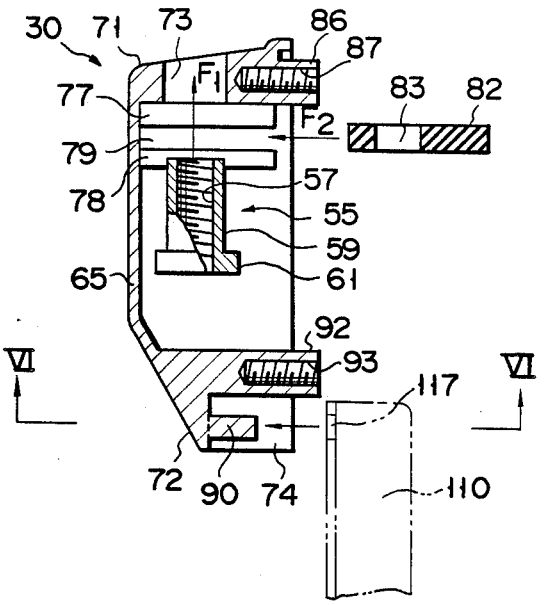
FIG. 5 is a partially exploded sectional view of the tightening device shown in FIG. 1.

As shown in FIG. 4, a pair of projecting walls 77 and a pair of ridges 78 are formed side by side on the inner surface of lug body 65. Channel 79 extends in the diametrical direction of tension bolt 41, between each wall 77 and its corresponding ridge 78. After nut 55 is inserted into first opening 73 in the direction of arrow $F_1$, as shown in FIG. 5, nut receiving plate 82 is inserted in the direction of arrow $F_2$ along channel 79. Plate 82, which is formed of elastomer such as synthetic rubber, is substantially rectangular in plane shape, and has hole 83 through which tension bolt 41 is passed. Distance W (see FIG. 4) between the two projecting walls 77 is a little wider than the width of flange 61 of nut 55. As flange 61 of nut 55 in opening 73 is held between walls 77, therefore, nut 55 is prevented from turning.

Columnar first projection 86 is located in the vicinity of first end 71. It is small enough to be fitted in first hole 21 of drum shell 11. Tapped hole 87 is formed in projection 86, which projects toward shell 11.

Pin-shaped second projection 90 is disposed on the inner surface side of second opening 74. It also projects toward drum shell 11. Columnar third projection 92 is located in the vicinity of projection 90. It projects in the same direction as first and second projections 86 and 90, and has a tapped hole 93 formed therein.

Lug body 65 is fixed to drum shell 11 by screwing first and second screws 96 and 97 into tapped holes 87 and 93, respectively. The other lug body 66, like body 65, is provided with first, second, and third projections 101, 102 and 103 (see FIG. 1), and is fixed to shell 11 by means of a pair of screws 105 and 106.

Figure 6:
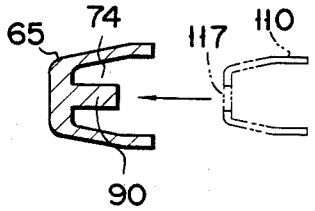
FIG. 6 is a sectional view taken along line VI—VI of FIG. 5.

Lug bodies 65 and 66 are connected to each other by means of connecting member 110. Member 110 has a longitudinal axis extending along the axis of drum shell 11. Opposite end portions 113 and 114 of member 110 are fitted in second openings 74 and 111 of bodies 65 and 66, respectively. As shown in FIG. 6, the cross section of connecting member 110 perpendicular to the axial direction thereof is substantially U-shaped. Thus, the cross-sectional shape of member 110 substantially agrees with the configuration of the second opening of each lug body. Also, the cross-sectional shape of member 110 is uniform throughout its length.

Figure 2:
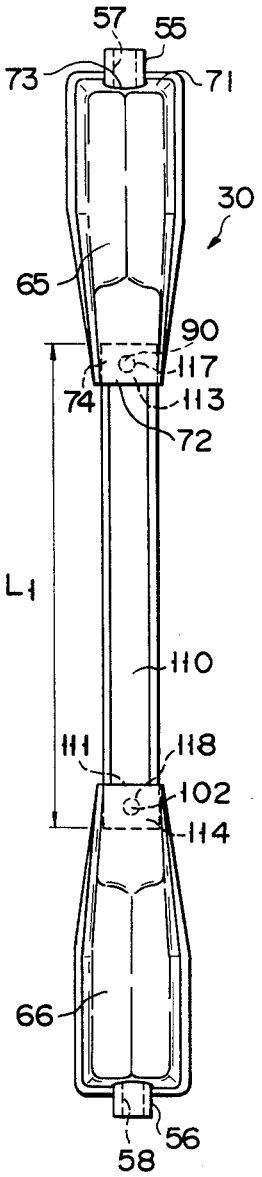
FIG. 2 is view of the tightening device shown in FIG. 1.
Figure 7:
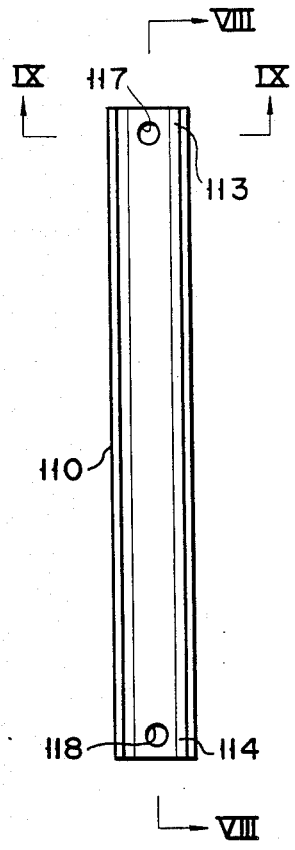
FIG. 7 is a rear view of a connecting member of the tightening device shown in FIG. 1.
Figure 8:
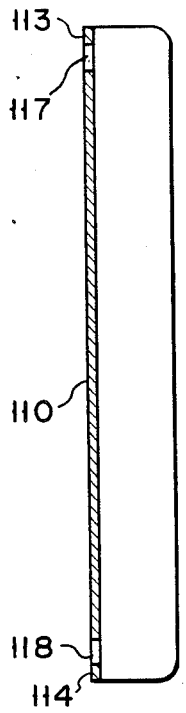
FIG. 8 sectional view taken along line VIII—VIII of FIG. 7.
Figure 9:
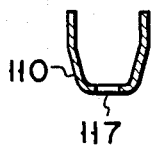
FIG. 9 is a sectional view taken along line IX—IX of FIG. 7.

Connecting member 110 is obtained by pressing a belt-shaped cut iron plate with predetermined length $L_1$ into a U-shaped cross-sectional configuration. Length $L_1$ in FIg. 2 corresponds to the length, in the axial direction, of drum shell 11. As shown in FIGS. 7 to 9, third holes 117 and 118, which are adapted to engage second projections 90 and 102 of lug bodies 65 and 66, respectively, are formed at the end portions 113 and 114 of member 110, respectively. The surface of member 110 is chromium-plated in the same manner as those of bodies 65 and 66.

Before lug bodies 65 and 66 are fixed to drum shell 11, nuts 55 and 56 and nut receiving plates 82 and 119 are attached to bodies 65 and 66, respectively. Bodies 65 and 66 are connected to each other by means of connecting member 110, and are then fixed to shell 11 by means of screws 96, 97, 1-5 and 106. Tension bolts 41 and 42 are inserted into second holes 37 and 38 of hoops 31 and 32, respectively, and are then screwed into nuts 55 and 56, respectively. When bolts 41 and 42 are rotated clockwise by means of the tuning key, edges 26 and 27 of drum heads 15 and 16 are pulled toward each other, so that tension can be applied to heads 15 and 16. At this time, lug body 65 is subjected to a force in the direction pulling connecting member 110 upwards, while lug body 66 is subjected to a force in the direction pulling member 110 downwards. Since bodies 65 and 66 are coupled to member 110 by means of second projections 90 and 102, the forces in the two opposite directions balance with each other through the medium of member 110. Thus, the force to tension drum heads 15 and 16 acts substantially straight in the axial direction of tension bolts 41 and 42. In consequence, only a small bending stress is produced in drum shell 11 and bolts 41 and 42.

Figure 10:
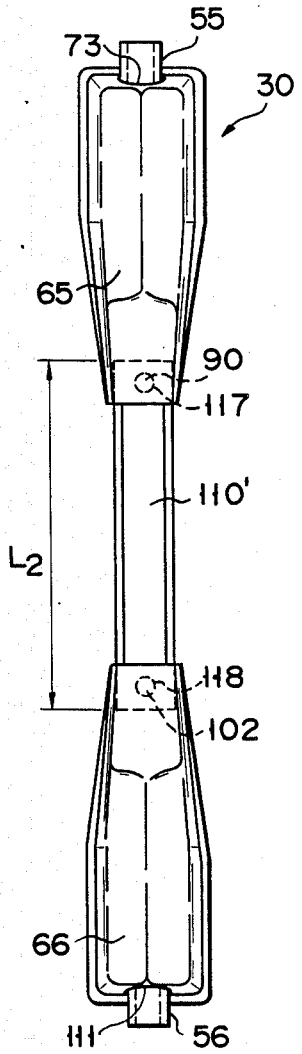
FIG. 10 is a front view of the tightening device using a connecting member of another type.

If the axial length of drum shell 11 of the drum is shorter than in the case of the embodiment described above, connecting member 110′ having shorter length $L_2$ is used, as shown in FIG. 10. In this case, nuts 55 and 56 and lug bodies 65 and 66 of the foregoing embodiment can be used without any modification. Member 110′ has the same cross-sectional shape as connecting member 110 of the first embodiment. By thus alternatively using connecting member 110 or 110′ for the connection of lug bodies 65 and 66, tightening device 30 can be used with drum shells 11 of various sizes. Since members 110 and 110′ are formed by pressing, they can be manufactured at low cost, depending on the length desired.

Figure 11:
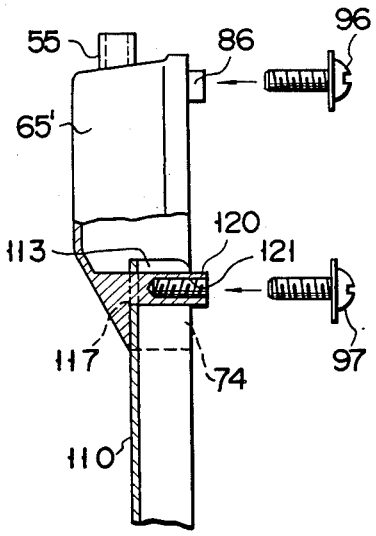
FIG. 11 is a side view, partially in section, showing part of a tightening device according to a second embodiment of the present invention.

In a second embodiment of the present invention shown in FIG. 11, lug body 65′ is formed with second projection 120 having the same shape as first projection 86. Projection 120 has tapped hole 121 extending in its projecting direction. Second screw 97 is screwed in hole 121. Body 65′ and connecting member 110 are connected in a manner such that end portion 113 of member 110 is fitted in second opening 74 of body 65′, and that second projection 120 is fitted in third hole 117. Lug body 65′, like lug body 65 of the first embodiment, is fixed to drum shell 11 by means of a pair of screws 96 and 97. Since body 65′ of this embodiment requires only two projections 86 and 120, molds of a simpler construction than that of molds used for body 65 of the first embodiment may be used to cast body 65′.

Figure 12:
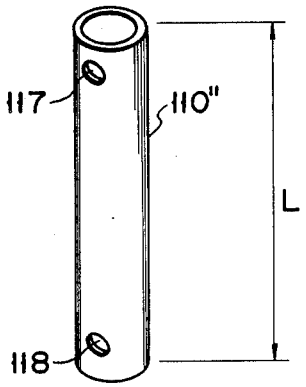
FIG. 12 is a perspective view showing a modification of the connecting member.

In the embodiments described above, connecting members 110 and 110′ are products obtained by pressing a metal plate. Alternatively, however, they may be each formed of straight cut metal pipe 110″ having a circular cross section and predetermined length L, as shown in FIG. 12.

What is claimed is:

1. A tightening device for applying tension to a pair of drum heads individually covering two opposite end openings of a drum shell open at both ends in the axial direction and having first holes, comprising:

a pair of hoops arranged along the respective edges of the drum heads, each said hoop having second holes arranged circumferentially at regular intervals;

tension bolts, each including a shank portion having an external thread, said shank portion being passed through each corresponding second hole;

nuts, each including a cylinder portion and a flange situated at one end thereof, said cylinder portion having an internal thread mating with the external thread of each corresponding tension bolt;

a pair of metallic lug bodies formed by casting, each said lug body being in the form of a box open on the drum shell side and having first and second ends situated opposite each other, said first end having a first opening in which the cylinder portion of each corresponding nut is inserted, and said second end having a second opening, said first and second openings extending in the axial direction of the drum shell;

first projections, each located in the vicinity of the first end of each said lug body and adapted to be inserted into the first hole of the drum shell, each said first projection having a tapped hole, second projections, each located in the vicinity of the second end of each said lug body and projecting toward the drum shell;

rotation preventing means inside each said lug body for preventing each said nut from rotating;

first screws screwed individually in the tapped holes of the first projections of the lug bodies, said lug bodies being adapted to be fixed to the drum shell as the screws are screwed into the tapped holes; and a connecting member for connecting the paired lug bodies, said connecting member having a longitudinal axis extending in the axial direction of the drum shell and two opposite end portions fitted individually in the second openings of the lug bodies, the cross section of said connecting member, with respect to the direction perpendicular to said longitudinal axis, being uniform throughout the axial length, each said opposite end portion of said connecting member having a third hole in which the second projection of each corresponding lug body is fitted.

2. The tightening device according to claim 1, further comprising third projections each located in the vicinity of the second projection of each said lug body and projecting toward the drum shell, each said third projection having a tapped hole in which a second screw for fixing each corresponding lug body to the drum shell is screwed.

3. The tightening device according to claim 1, wherein the second projection of each said lug body has a tapped hole in which a second screw for fixing the lug body to the drum shell is screwed.

4. The tightening device according to claim 1, wherein said connecting member is formed by pressing a metal plate with a predetermined length into a U-shaped cross-sectional configuration.

5. The tightening device according to claim 1, wherein said connecting member is formed by cutting a straight metal pipe with a circular cross section into a predetermined length.

6. The tightening device according to claim 1, further comprising a pair of ridges formed inside each said lug body and extending in the diametrical direction of each corresponding tension bolt, and a receiving plate made of elastomer interposed between each said ridges and each flange of corresponding nut.

* * * * *